US010954748B2

(12) United States Patent
Greci et al.

(10) Patent No.: US 10,954,748 B2
(45) **Date of Patent: *Mar. 23, 2021**

(54) TUBING ASSEMBLY FOR HYDRAULIC SHIFTING OF SLEEVE WITHOUT TOOL MOVEMENT

(71) Applicant: Halliburton Energy Services, Inc., Houston, TX (US)

(72) Inventors: Stephen Michael Greci, Little Elm, TX (US); Thomas Jules Frosell, Irving, TX (US); Michael Linley Fripp, Carrollton, TX (US); Gary John Geoffroy, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/910,946

(22) Filed: Jun. 24, 2020

(65) Prior Publication Data

US 2020/0318457 A1 Oct. 8, 2020

Related U.S. Application Data

(63) Continuation of application No. 15/759,410, filed as application No. PCT/US2017/021317 on Mar. 8, 2017, now Pat. No. 10,711,572.

(51) Int. Cl.
*E21B 17/18* (2006.01)
*E21B 23/04* (2006.01)
(Continued)

(52) U.S. Cl.
CPC ..... *E21B 34/10* (2013.01); *E21B 17/18* (2013.01); *E21B 23/04* (2013.01); *E21B 34/14* (2013.01); *E21B 2200/06* (2020.05)

(58) Field of Classification Search
CPC ..... E21B 17/18; E21B 23/04; E21B 34/10; E21B 34/14
See application file for complete search history.

(56) References Cited

U.S. PATENT DOCUMENTS 2,251,977 A * 8/1941 Burt ..... E21B 33/146 166/156
4,332,298 A * 6/1982 Kuus ..... E21B 33/127 166/319

(Continued)

FOREIGN PATENT DOCUMENTS

WO 2015065335 5/2015

OTHER PUBLICATIONS

U.S. Appl. No. 15/759,410 , "Advisory Action", dated Oct. 25, 2019, 4 pages.

(Continued)

*Primary Examiner* — Matthew R Buck
(74) *Attorney, Agent, or Firm* — Kilpatrick Townsend & Stockton LLP

(57) ABSTRACT

A sleeve on a downhole work string or a completion string may be actuated without movement of the work string, by positioning the work string within the completion string such that a sleeve positioned in a recess on a surface the work string or the completion string, in combination with surfaces of the work string and the completion string define a chamber on a side of the sleeve. A fluid may be pumped from a fluid source through a fluid passageway in the work string to the chamber for forcing the sleeve to actuate from an open position to a closed position or vice versa. In some aspects, multiple sleeves may be actuated concurrently via additional fluid passageways that are in fluid communication with one another. In some aspects, multiple sleeves may be (Continued)

actuated independently via additional fluid passageways that are fluidly isolated from one another.

20 Claims, 9 Drawing Sheets

(51) Int. Cl.
*E21B 34/10* (2006.01)
*E21B 34/14* (2006.01)

(56) References Cited

U.S. PATENT DOCUMENTS 4,603,741 A * 8/1986 Edgmon ..... E21B 34/14 166/317
7,861,788 B2 * 1/2011 Tips ..... E21B 34/102 166/319
8,567,509 B1 * 10/2013 Kippola ..... E21B 34/102 166/373
8,757,265 B1 * 6/2014 Cuffe ..... E21B 33/14 166/308.1
10,711,572 B2 * 7/2020 Greci ..... E21B 17/18
2004/0154798 A1 * 8/2004 Vincent ..... E21B 33/16 166/291
2007/0119594 A1 5/2007 Turner et al.
2009/0044944 A1 * 2/2009 Murray ..... E21B 43/02 166/308.1
2010/0314562 A1 * 12/2010 Bisset ..... E21B 34/06 251/12
2012/0279723 A1 * 11/2012 Hofman ..... E21B 34/103 166/373
2013/0056206 A1 * 3/2013 Jackson ..... E21B 34/102 166/281
2015/0041148 A1 * 2/2015 Greenan ..... E21B 34/103 166/374
2018/0163507 A1 * 6/2018 Wakefield ..... E21B 34/14
2018/0223626 A1 * 8/2018 Wakefield ..... E21B 34/066

OTHER PUBLICATIONS

U.S. Appl. No. 15/759,410 , "Final Office Action", dated Aug. 16, 2019, 13 pages.
U.S. Appl. No. 15/759,410 , "Non-Final Office Action", dated Mar. 13, 2019, 12 pages.
U.S. Appl. No. 15/759,410 , "Non-Final Office Action", dated Nov. 21, 2019, 8 pages.
U.S. Appl. No. 15/759,410 , "Notice of Allowance", dated Mar. 11, 2020, 6 pages.
PCT/US2017/021317 , "International Search Report and Written Opinion", dated Nov. 27, 2017, 15 pages.

* cited by examiner

TUBING ASSEMBLY FOR HYDRAULIC SHIFTING OF SLEEVE WITHOUT TOOL MOVEMENT

CROSS-REFERENCE TO RELATED APPLICATIONS

This application is a continuation of U.S. application Ser. No. 15/759,410 titled "Tubing Assembly for Hydraulic Shifting of Sleeve Without Tool Movement," filed Mar. 12, 2018, which claims priority to and is a National Stage Entry of PCT Application No. PCT/US2017/021317, titled "Tubing Assembly for Hydraulic Shifting of Sleeve Without Tool Movement" and filed Mar. 8, 2017, the entirety of both of which are incorporated herein by reference.

TECHNICAL FIELD

The present disclosure relates generally to wellbore assemblies, and more specifically (although not necessarily exclusively), to a work string and a completion string for hydraulically shifting a sleeve of the completion string.

BACKGROUND

During well drilling and completion, a completion string may be run into the wellbore of well traversing a hydrocarbon-bearing subterranean formation. The completion string can include a sleeve that can move from an open position to a closed position.

DETAILED DESCRIPTION

Certain aspects and features relate to completion strings that include an opening or fluid passageway between an outer surface of the completion string defining an outer region (e.g. a wellbore annulus) and an inner surface of the completion string defining an inner region of the completion string. The completion string may include a sleeve that is moveable from an open position to a closed position to control a fluid flow through the fluid passageway. In some aspects, the sleeve may include a fluid passageway or opening from an outer surface of the sleeve to an inner surface of the sleeve, and may be moved repeatedly from the open position to the closed position and vice-versa, for example by a work string and a plurality of seals forming a hydraulic seal with the completion string.

The work string can be positioned within the completion string. A chamber can be formed on one side of the sleeve when the work string is positioned within the completion string. The work string and the completion string can each include sealing elements that seal spaces between the completion string and the work string. The sealing elements may form a hydraulic seal between the completion string and the work string such that the chamber can be a hydraulic chamber. Fluid may be pumped into the hydraulic chamber via a fluid passageway or port in the work string and may force the sleeve to move from a closed position to an open position.

In some aspects, a second chamber may be positioned at the opposite end of the sleeve and recess, defined by the work string and the completion string. The second chamber may be hydraulically sealed by multiple sealing elements. Fluid may be pumped into a second hydraulic chamber via another fluid passageway in the work string and may force the sleeve from the open position to the closed position.

In some aspects the completion string may include multiple fluid passageways and sleeves. In some aspects the work string may include separate fluid passageways in communication with each individual chamber on a side of each sleeve. In some aspects the work string may include a fluid passageway that is in fluid communication with two or more chambers on a side of each sleeve. Fluid may be pumped through the fluid passageways of the work string by a fluid source. The fluid source may be located at the surface of the wellbore. In some aspects the fluid source may be located within the wellbore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
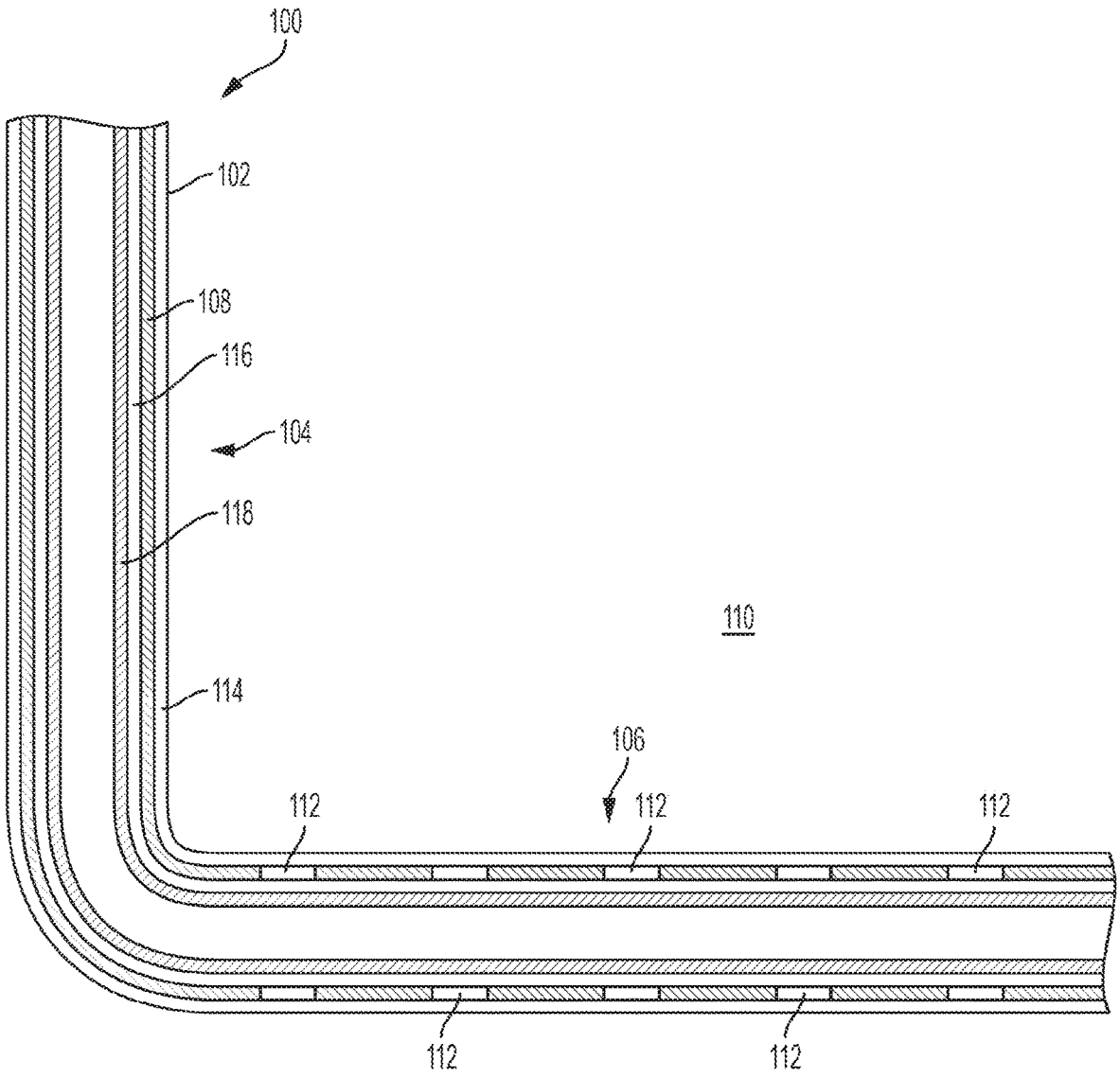
FIG. 1 is a schematic illustration of a well system having a completion string including a sliding sleeve according to one aspect.

FIG. 1 depicts a well system 100 including a bore that is a wellbore 102 extending through various earth strata. The wellbore 102 has a substantially vertical section 104 and a substantially horizontal section 106. The substantially horizontal section 106 extends through a hydrocarbon bearing subterranean formation 110. The substantially vertical section 104 and the substantially horizontal section 106 may include a tubing string, for example completion string 108 extending from the surface within wellbore 102. The completion string 108 may include one or more openings, for example openings 112. The openings 112 can be positioned along the completion string 108 in various production intervals and can define a fluid passageway between the annulus 114 of the wellbore 102 and an inner surface of the completion string that defines an inner region 116 of the completion string 108.

As described in further detail below, the completion string 108 can also include a sleeve for each of the openings 112. The sleeves may move between an open position and a closed position. In some aspects, the sleeves can move repeatedly between the open position and the closed position. The sleeves can control the fluid communication between the outer surface of the completion string 108, which is positioned adjacent the annulus 114 and the inner region 116 of the completion string 108 via the opening 112 by its position in either the open position or the closed position. A work string 118, for example a tool string, may be positioned within the completion string 108. The work string 118 may be used to shift one or more of the sleeves between the open position and the closed position.

Figure 2:
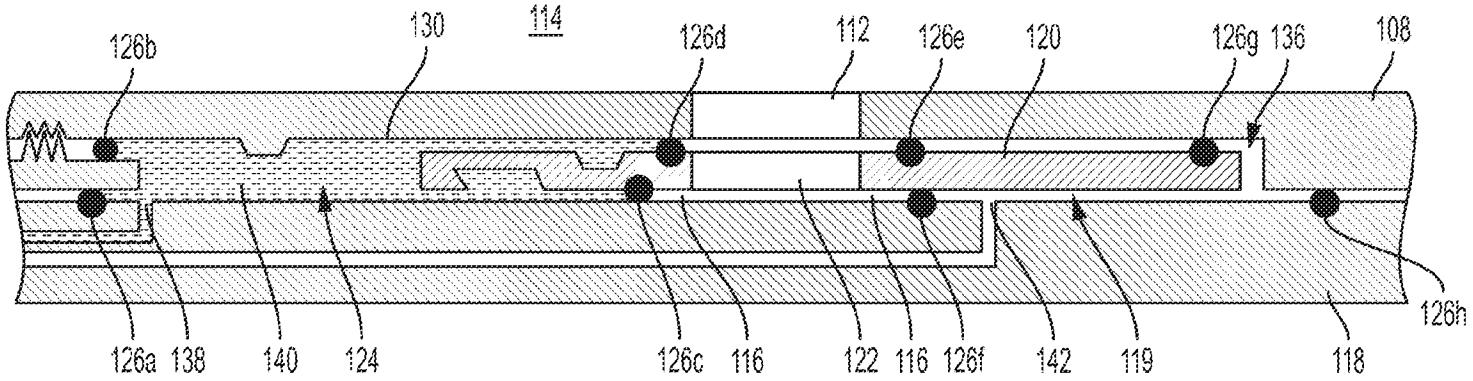
FIG. 2 is a cross-sectional view of part of a completion string with a work string positioned within the completion string, with the sleeve in an open position.
Figure 9:
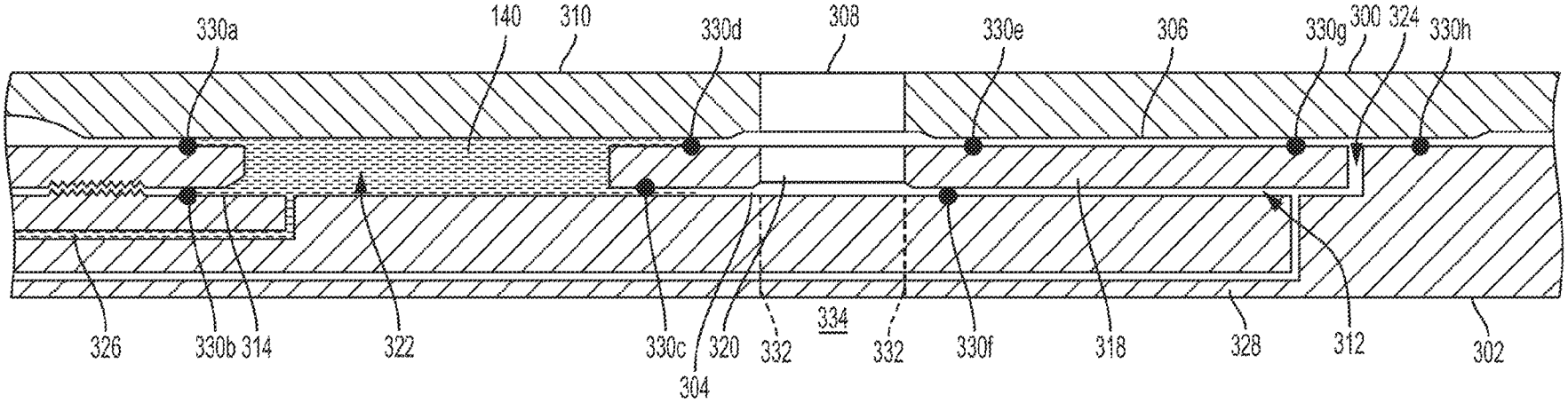
FIG. 9 is a cross-sectional view of part of a completion string with a work string positioned within the completion string, with the sleeve in an open position, according to an aspect of the present disclosure.

FIG. 2 depicts a partial cross-sectional view of a work string, for example the work string 118, positioned within a tubing string, for example the completion string 108, according to an aspect of the present disclosure. The work string 118 may be run in with the completion string 108. In other aspects the work string 118 may be be run into the completion string 108 after the completion string 108 has been positioned downhole. The completion string 108 includes a recess 119 in an inner surface 130 of the completion string 108 in which a sleeve 120 is positioned. The recess 119 can be sized to receive the sleeve 120. In some aspects, for example an aspect shown in FIG. 9, the work string may include a recess that receives a sleeve. The sleeve 120 includes a fluid passageway or an opening 122. The sleeve 120 may be moved to an open position or a closed position via the work string 118. The work string 118 may be stationary as it controls the position of the sleeve 120. In FIG. 2, the sleeve 120 is shown in the open position, with the sleeve 120 positioned within the recess 119 such that the opening 122 of the sleeve 120 is aligned with the opening 112 of the completion string 108. With the sleeve 120 in the open position, fluid may flow from the annulus 114 of the wellbore 102 (shown in FIG. 1) through the opening 112 of the completion string 108 and the opening 122 of the sleeve 120 into the inner region 116 of the completion string 108 defined by the inner surface 130 of the completion string 108. In some aspects, the work string 118 may include an opening or port adjacent to the opening 112 in the completion string, for example as shown in FIG. 9, providing a flow path to an inner region of the work string 118.

Figure 3:
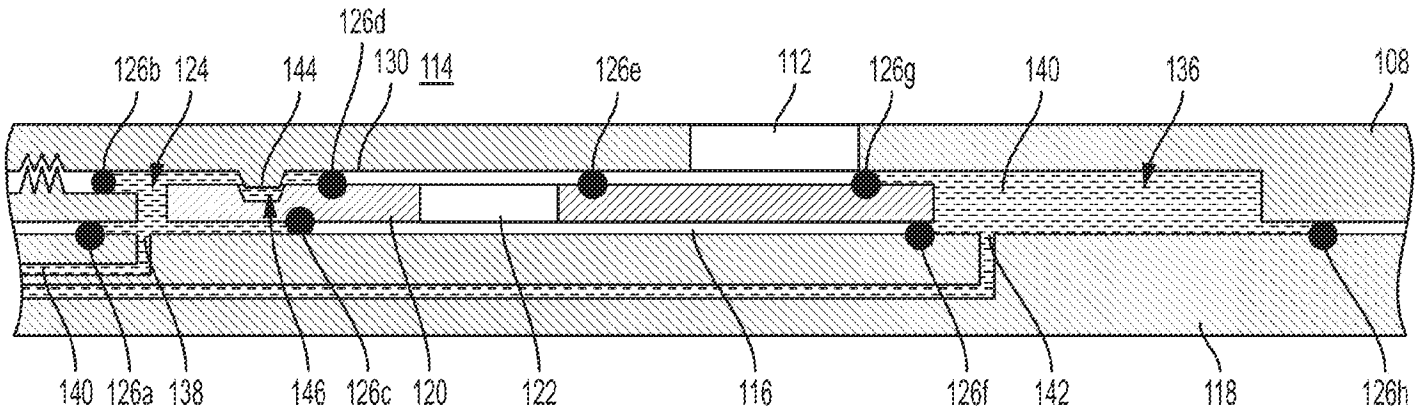
FIG. 3 is a cross-sectional view of the part of the completion string and work string of FIG. 2 with the sleeve in a closed position.

As shown in FIGS. 2 and 3, the recess 119, the completion string 108 (including the sleeve 120) and the work string 118 together define a first chamber 124 on a side of the sleeve 120. Multiple sealing elements, for example seals 126*a*, 126*b*, 126*c*, and 126*d* positioned on the completion string 108 and the work string 118, together create a hydraulic seal between the completion string 108 (including sleeve 120) and the work string 118 such that the first chamber 124 is a hydraulic chamber. While the seal 126*a* is shown on the work string 118, in some aspects the seal 126*a* may be positioned on the completion string 108. Also, while the seal 126*c* is shown positioned on the sleeve 120, in some aspect the seal 126*b* could be positioned on the work string 118. Similarly, while the seal 126*d* is shown positioned the sleeve 120 of the completion string 108, in some aspects the seal 126*d* could be positioned on the inner surface 130 of the completion string 108. Thus, the seals 126*a*, 126*b*, 126*c*, and 126*d* may be positioned in various combinations on the completion string 108 (including the sleeve 120) and the work string 118, to achieve a hydraulic seal about the first chamber 124.

A second chamber 136 can be positioned at an opposite end of the sleeve 120 as the first chamber 124. As with the first chamber 124, the second chamber 136 may be defined by the recess 119, the completion string 108 (including the sleeve 120) and the work string 118. Sealing elements, for example seals 126*f*, 126*g*, and 126*h* positioned on the completion string 108 and the work string 118, together create a hydraulic seal between the completion string 108 (including sleeve 120) and the work string 118 such that the second chamber 136 is a hydraulic chamber. In some aspects, additional seals, for example seal 126*e* may be positioned on the sleeve 120 to control the flow of fluid entering the opening 112 in the completion string 108.

The work string 118 includes a fluid passageway or first port 138 that defines a pathway between a fluid source and the first chamber 124. The first port 138 may be in fluid communication with a fluid source at the surface of the wellbore 102 (shown in FIG. 1) in some aspects the fluid source may be positioned within the wellbore. Fluid 140, for example wellbore fluid, can enter the first chamber 124 via the first port 138.

The work string 118 may also include a second fluid passageway or port 142 that defines a pathway between a fluid source and the second chamber 136. The second port 142 may be in fluid communication with a fluid source at the surface of the wellbore 102, in some aspects the fluid source may be positioned within the wellbore. Fluid 140, for example wellbore fluid, can enter the second chamber 136 via the second port 142.

As shown in FIGS. 2 and 3, fluid 140 can be pumped into the first chamber 124. The seals 126*a*, 126*b*, 126*c*, and 126*d* can prevent the fluid 140 from exiting the first chamber 124. As the first chamber 124 fills, the fluid 140 can force the sleeve 120 to move towards the second chamber 136. The fluid 140 can move the sleeve 120 into the open position by forcing the sleeve 120 to move towards the second chamber 136, which may cause the opening 122 in the sleeve 120 to align with the opening 112 in the completion string 108. In some aspects, the sleeve 120 can also be forced from the open position to the closed position (shown in FIG. 3), such that the opening 122 in the sleeve 120 no longer aligns with the opening 112 in the completion string 108. The sleeve 120 may be hydraulically balanced such that the sleeve 120 can remain in the open position without further intervention or action. In some aspects, the sleeve 120 may be secured in the open position, for example via a collet positioned on the sleeve 120 or the completion string 108 and a recess positioned on the sleeve 120 or the completion string 108. In some aspects, other suitable securing features may be used.

FIG. 3 is a cross-sectional depiction of the sleeve 120 of the completion string 108 of FIG. 2 in the closed position, according to an aspect of the present disclosure. The sleeve 120 can be moved from the open position (shown in FIG. 2) to the closed position by pumping fluid 140 through the second port 142 into the second chamber 136. The seals 126*f*, 126*g*, and 126*h* can prevent the fluid 140 from exiting the second chamber 136 as fluid 140 is pumped in. As the second chamber 136 fills, the fluid 140 can force the sleeve 120 towards the first chamber 124. The fluid 140 in the first chamber 124 can flow out of the first chamber 124 via the first port 138. The size of the second chamber 136 can increase as fluid is pumped in, and the size of the first chamber 124 can decrease as the sleeve 120 moves towards the first chamber 124. The fluid 140 in the second chamber 136 can move the sleeve 120 into the closed position by forcing the sleeve 120 to move such that the opening 122 of the sleeve 120 no longer aligns with the opening 112 of the completion string 108.

In some aspects, the first chamber 124 and second chamber 136 may be hydraulically balanced such that the sleeve 120 remains in the closed position. In some aspects, the sleeve 120 may be secured in place via a securing feature, for example a projection and a recess that mate together. For example, the inner surface 130 of the completion string 108 may include a projection, for example a collet 144 that may be received in a recess, for example a recess 146 on the sleeve 120. The collet 144 may be received in the recess 146 to secure the sleeve 120 in place in the closed position. In some aspects, other suitable means for securing the sleeve 120 in the closed position may be used.

The pressure at the sleeve 120 can be monitored from the surface and may indicate if the sleeve 120 is in the open position or the closed position. For example, in some aspects the sleeve 120 may be pressure tested to determine if it is in the closed position by monitoring the pressure in the work string 118 as fluid is pumped into the second chamber 136. A pressure increase in the second chamber 136 can indicate the sleeve 120 is in the closed position.

The hydraulic sealing of the first chamber 124 and the second chamber 136 via sealing the spaces between the work string 118 and the completion string 108 (including the sleeve 120) can permit the control of the position of the sleeve 120 using a thin completion string 108, which can permit drilling a smaller wellbore 102 (shown in FIG. 1). The completion string 108 may be thin as it may not require a thicker wall when the work string 118 is sealed against the completion string 108 to form the first and second chambers 124 and 136.

Figure 4:
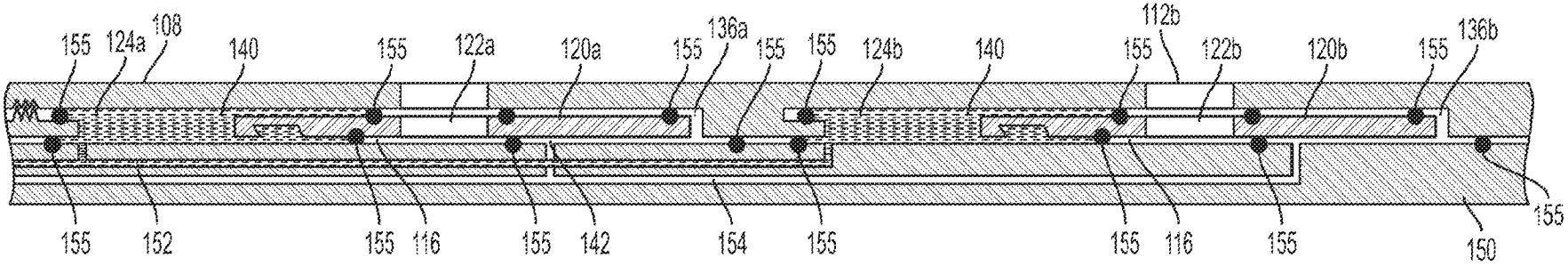
FIG. 4 is a cross-sectional view of part of a work string positioned within a completion string, the completion string having multiple sleeves shown in the open position, according to an aspect of the present disclosure.
Figure 5:
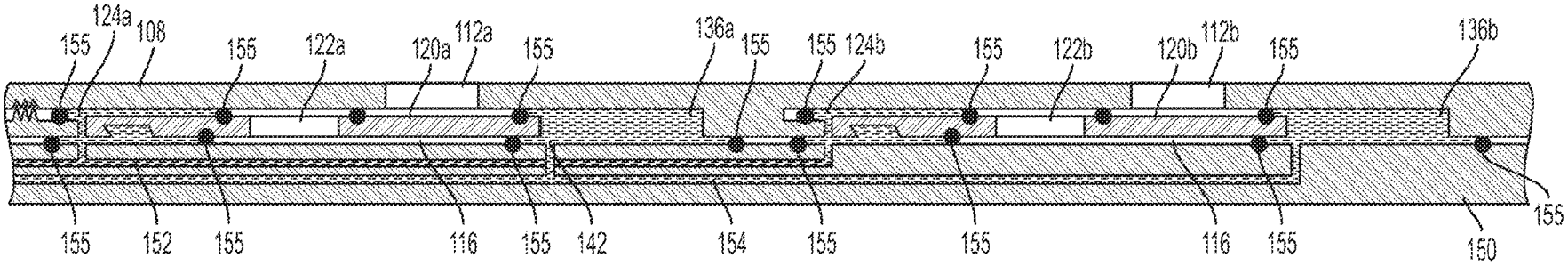
FIG. 5 is a cross-sectional view of part of the completion string of FIG. 4 with the sleeves shown in the closed position.

FIGS. 4 and 5 are partial cross-sectional depictions of an aspect of the disclosure in which a completion string, for example completion string 108 has multiple sleeves, for example sleeves 120*a*, 120*b*. Each sleeve 120*a*, 120*b* can also include an opening, for example openings 122*a*, 122*b* which may be aligned with openings 112*a*, 112*b* in the completion string 108. The completion string 108 may have more or fewer sleeves and openings than shown in FIGS. 4 and 5. The figures depict a work string 150 positioned in the inner region 116 of the completion string 108. The sleeves 120*a*, 120*b* can each be moved from an open position to a closed position as described above with reference to FIGS. 2 and 3 by pumping fluid into a chamber on either side of each of the sleeves 120*a*, 120*b*. In some aspects, each of the sleeves 120*a*, 120*b* can each be moved together between the open and closed positions. FIGS. 4 and 5 depict an aspect in which the work string 150 includes a first port or first fluid passageway 152 that is in fluid communication with a first chamber of each of the sleeves 120*a*, 120*b*, for example first chambers 124*a*, 124*b* and a fluid source (not shown). The work string 150 may also include a second port or fluid passageway 154 that is in fluid communication with the second chambers of each sleeve 120*a*, 120*b*, for example second chambers 136*a*, 136*b*, and a fluid source (not shown). In some aspects, the work string 150 may include an opening or port adjacent to each of the openings 112*a*, 112*b* in the completion string 108, for example as shown in FIG. 9, providing a fluid passageway to an inner region of the work string 150.

The sleeves 120*a*, 120*b* can each be moved to the open position by pumping fluid through the first fluid passageway 152 into the each of the first chambers 124*a*, 124*b*. The first chambers 124*a*, 124*b* can each be hydraulic chambers by positioning multiple sealing elements, for example seals 155 that seal spaces between the completion string 108 and the work string 150. In some aspects, the sealing elements may be O-ring seals or other suitable sealing elements, for example but not limited to molded elastomer seals, non-elastomer seal stacks, metal to metal seals, and flexible graphite seals. As shown in FIG. 5, the sleeves 120*a*, 120*b* can also be moved to the closed position by pumping fluid 140 through the second fluid passageway 154 and into each of the second chambers 136*a*, 136*b*.

Figure 6:
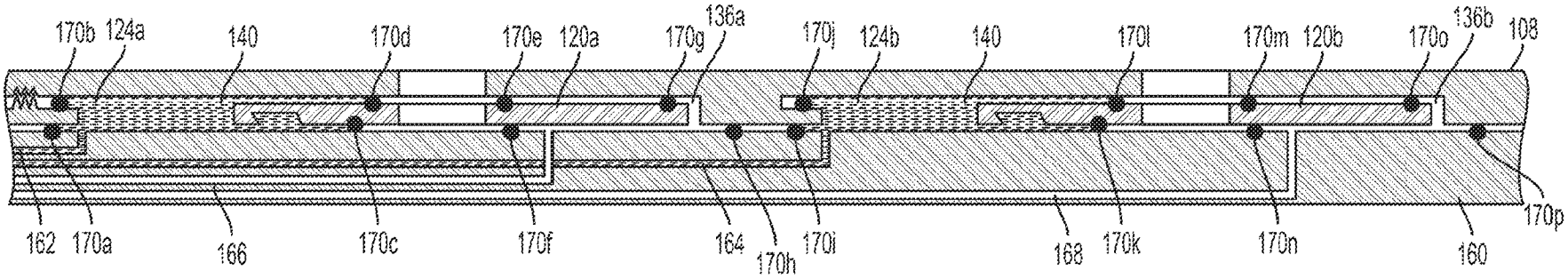
FIG. 6 is a cross-sectional view of part of a work string positioned within a completion string, the completion string having multiple sleeves shown in the open position, according to an aspect of the present disclosure.

FIG. 6 is a cross-sectional depiction of a work string 160 positioned within the completion string 108, according to an aspect of the disclosure. In the aspect shown in FIG. 6, the sleeves 120*a*, 120*b* can be moved independently between the open position and the closed position. The work string 160 includes a first port or fluid passageway 162 and in fluid communication with the first chamber 124*a* and a second port or fluid passageway 164 that is in fluid communication with the other first chamber 124*b*. The sleeves 120*a*, 120*b* can each be moved to the open position (as shown in FIG. 6) by pumping fluid through each of the fluid passageways 162, 164 to move each of the respective sleeves 120*a*, 120*b* to the open position. Fluid 140 may be pumped through one, both, or neither of the fluid passageways 162, 164 to position each of the sleeves 120*a*, 120*b* in an open position when desired. For example, fluid 140 may be pumped into the first chamber 124*a* via the fluid passageway 162 to move the sleeve 120*a* to the open position. Fluid may not be pumped through the fluid passageway 164 such that the first chamber 124*b* remains empty and the sleeve 120*b* remains in the closed position.

Similarly, the work string 160 can include separate ports or fluid passageways 166, 168 to each of the second chambers 136*a*, 136*b*. The sleeves 120*a*, 120*b* can each be moved individually to a closed position (not shown) by pumping fluid 140 through the respective fluid passageways 166,168 to fill one or both of the second chambers 136*a*, 136*b* and move the desired sleeve 120*a*, 120*b* to the closed position (not shown). For example, fluid 140 may be pumped into the second chamber 136*b* via the fluid passageway 168 to fill the second chamber 136*b* and position the sleeve 120*b* in the closed position (not shown). Fluid may not be pumped into the second chamber 136*a* via the fluid passageway 166, such that the second chamber 136*a* remains empty and the sleeve 120*a* remains in the open position (not shown).

As described above with reference to FIGS. 2 and 3, each of the first chambers 124*a*, 124*b* and second chambers 136*a*, 136*b* can be hydraulic chambers sealed by multiple sealing elements on the completion string 108 (including the sleeve 120) and the work string 160. For example, seals 170*a*, 170*b*, 170*c*, and 170*d* can prevent the fluid 140 from exiting the first chamber 124*a* when fluid 140 is pumped through the fluid passageway 162. Seals 170*f*, 170*g*, and 170*h* can prevent the fluid 140 from exiting the second chamber 136*a* when fluid 140 is pumped through the fluid passageway 166. Additional seals, for example seal 170*e* may also be positioned on the sleeve 120*a* or the completion string 108. The seals 170*a*, 170*b*, 170*c*, and 170*d* can be positioned in various combinations on the completion string 108 (including the sleeve 120) and the work string 160 to hydraulically seal the first chamber 124*a*. The seals 170*f*, 170*g*, and 170*h* can also be positioned in various combinations on the completion string 108 (including the sleeve 120) and the work string 160 to hydraulically seal the second chamber 136*a*. Similarly, the first chamber 124*b* and second chamber 136*b* can each be hydraulically sealed via seals 170*i*, 170*j*, 170*k*, 170*l*, 170*n*, 170*o*, and 170*p*, respectively. In some aspects, additional seals, for example seal 170*e* can be positioned on the sleeve 120*b* or the completion string 108. In some aspects, the work string 160 may include an opening or port adjacent to each of the openings 112*a*, 112*b* in the completion string 108, for example as shown in FIG. 9.

Figure 7:
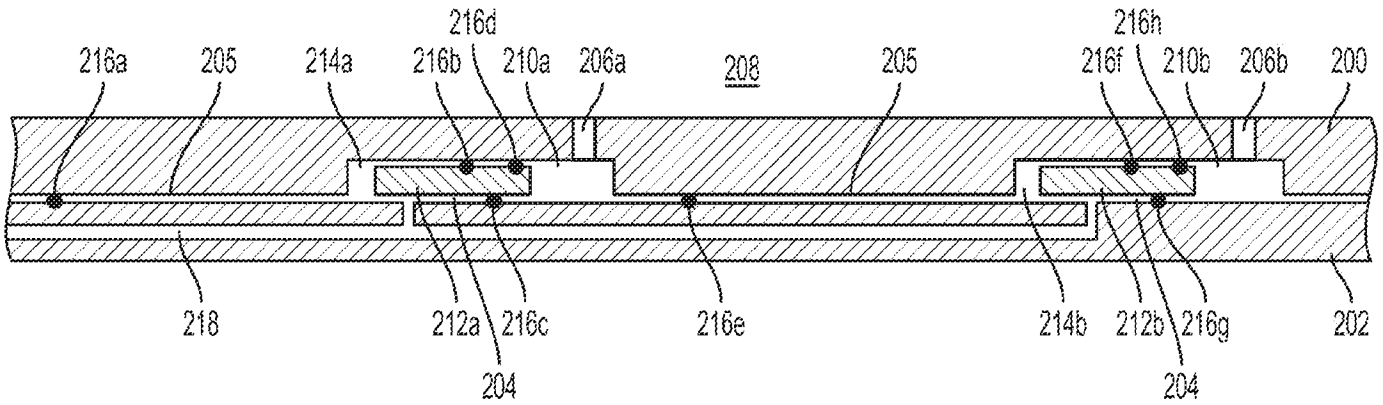
FIG. 7 is a cross-sectional view of part of a work string positioned within a completion string, the completion string having multiple sleeves shown in the open position, according to an aspect of the present disclosure.
Figure 8:
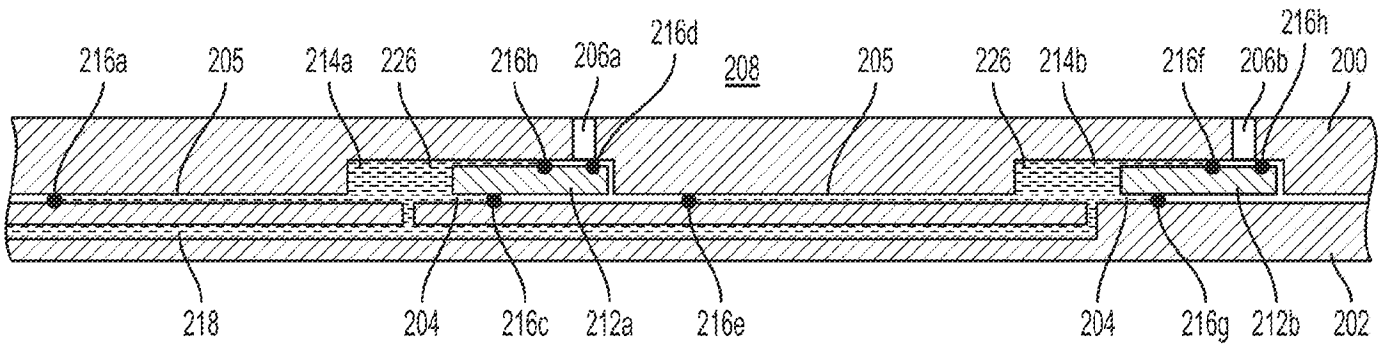
FIG. 8 is a cross-sectional view of part of the work string and the completion string of FIG. 7, with the sleeves shown in the closed position.

FIGS. 7 and 8 depict a partial cross-sectional view of a completion string 200 with a work string 202 positioned in an interior region 204 of the completion string 200 defined by an inner surface 205 of the completion string 200, according to an aspect of the disclosure. The completion string 200 includes openings 206*a*, 206*b* between the outer surface of the completion string 200 and the inner surface 205 of the completion string 200. The openings 206*a*, 206*b* define a fluid passageway between the outer surface of the completion string 200 (positioned proximate to an annulus 208 of the wellbore) and the inner region 204 of the completion string 200. The completion string 200 includes recesses 210*a*, 210*b* in the inner surface 205. The completion string 200 also includes a sleeve 212*a* positioned in the recess 210*a* and a sleeve 212*b* positioned in the recess 201*b*. The sleeves 212*a*, 212*b* are shown in an open position in FIG. 7 with the sleeves 212*a*, 212*b* both positioned away from the respective openings 206*a*, 206*b* such that fluid may flow from the annulus 208 through the openings 206*a*, 206*b* in the completion string 200 and into the inner region 204 of the completion string 200. The sleeves 212*a*, 212*b* may be moved to a closed position (as shown in FIG. 8) as described further below.

The work string 202 and the completion string 200 (including sleeve 212*a*) together may define a chamber 214*a* on one side of the sleeve 212*a*. Multiple sealing elements, for example seals 216*a*, 216*b*, and 216*c* may together seal the spaces between the completion string 200 (including the sleeve 212*a*) and the work string 202 around the chamber 214*a*. An additional seal, for example seal 216*d* may be sized and positioned on the sleeve 212*a* to seal off the opening 206*a* when the sleeve 212*a* is in the closed position. The seals 216*a*, 216*b*, and 216*c* may make the chamber 214*a* a hydraulic chamber. FIGS. 7 and 8 depict the seal 216*a* on the work string 202, though in some aspects it may be positioned on the inner surface 204 of the completion string 200. Seal 216*b* is depicted on the sleeve 212*a* such that as the sleeve 212*a* moves towards the opening 206*a* the seal 216*b* maintains a seal between the inner surface 205 of the completion string 200 and the sleeve 212*a*. In some aspects, the seals 216*a*, 216*b*, and 216*c* may be positioned in other combinations on the completion string 200 (including the sleeve 212*a*) and the work string 202 to hydraulically seal the chamber 214*a*. A port or fluid passageway 218 may extend from a fluid source (not shown) to the chamber 214*a*.

Similarly, the work string 202 and the completion string 200, including the sleeve 212*b* together may define a chamber 214*b* on one side of the sleeve 212*b*. Multiple sealing elements, for example seals 216*e*, 216*f*, and 216*g* may together seal the spaces between the completion string 200 and the work string 202 around the chamber 214*b*. An additional seal, for example seal 216*h* may be sized and positioned on the sleeve 212*b* to seal off the opening 206*b* when the sleeve 212*b* is in the closed position. The seals 216*e*, 216*f*, and 216*g* may make the chamber 214*b* a hydraulic chamber. The seal 216*e* is shown on the work string 202, though in some aspects it may be positioned on the inner surface 205 of the completion string 200. Seal 216*f* are is on the sleeve 212*b* such that as the sleeve 212*b* moves towards the opening 206*b* the seal 216*f* maintains a seal between the inner surface 205 of the completion string 200 and the sleeve 212*b*. Seal 216*g* is depicted on the work string 202, though in some aspects the seal 216*g* may be positioned on the sleeve 212*b*. In some aspects, the seals 216*e*, 216*f*, and 216*g* may be positioned in other combinations on the completion string 200 (including the sleeve 212*b*) and the work string 202 to hydraulically seal the chamber 214*b*. The fluid passageway 218 may extend from the fluid source to the chamber 214*b*. The fluid source can be positioned within the wellbore, in some aspects the fluid source may be positioned at the surface.

The sleeves 212*a*, 212*b* can both be moved to a closed position (shown in FIG. 8) by pumping fluid 226 through the fluid passageway 218, which is in fluid communication with both chamber 214*a* and chamber 214*b*, respectively. The sleeves 212*a*, 212*b* can be forced in the direction of the openings 206*a*, 206*b* as fluid 226 fills the chambers 214*a*, 214*b*. The seals 216*a*, 216*b*, 216*c*, 216*e*, 216*f*, and 216*g* can prevent the fluid 226 from leaking out of the chambers 214*a*, 214*b*.

FIG. 8 shows the chambers 214*a*, 214*b* filled with fluid 226 such that the sleeves 212*a*, 212*b* are forced into the closed position. In the closed position, the sleeves 212*a*, 212*b* may block the openings 206*a*, 206*b* in the completion string 200 such that fluid may not flow from the annulus 208 into the inner region 204 of the completion string 200. The chambers 214*a*, 214*b* may be hydraulically balanced such that the sleeves 212*a*, 212*b* remain in the closed position without any additional securing feature. In some aspects, the sleeves 212*a*, 212*b* may be secured in the closed position via a collet and recess or other securing feature between the sleeves 212*a*, 212*b* and the inner surface 205 of the completion string 200. In some aspects, the completion string 200 may only include a single sleeve, while in other aspects the completion string 200 may include multiple sleeves along its length.

In some aspects, the sleeves 212*a*, 212*b* may each be in fluid communication with different fluid passageway, as described with reference to FIG. 6. In some aspects, the sleeves 212*a*, 212*b* may each be forced from the open position to the closed position independently of one another where each chamber 214*a*, 214*b* is in fluid communication with a fluid source via a separate fluid passageway. In some aspects, the work string 202 may include an opening or port adjacent to each of the openings 206*a*, 206*b* in the completion string 200, for example as shown in FIG. 9.

FIG. 9 depicts a partial cross-sectional view of a completion string 300 with a work string 302 positioned in an inner region 304 of the completion string 300 defined by an inner surface 306 of the completion string 300, according to an aspect of the disclosure. The completion string 300 includes an opening 308 between an outer surface 310 of the completion string 300 and the inner surface 306 of the completion string 300. The opening 308 defines a fluid passageway between the outer surface 310 of the completion string 300 and the inner region 304 of the completion string 200. The work string 302 includes a recess 312 in an outer surface 314 of the work string 302. The work string 302 also includes a sleeve 318 positioned in the recess 312. The sleeve 318 may include a fluid passageway or opening 320. The sleeve 318 is shown in an open position in FIG. 9 with the opening 320 of the sleeve 318 being positioned adjacent to or aligned with the opening 308 of the completion string 300 such that fluid may flow from the outer surface 310 through the opening 308 in the completion string 300 and through the opening 320 in the sleeve 318 and into the inner region 304 of the completion string 300. The sleeve 318 of the work string 302 may be moved to a closed position (not shown) where the opening 320 of the sleeve 318 is not aligned with the opening 308 of the completion string 300 such that fluid may not flow from the outer surface 310 of the completion string 300 through to the inner region 304 of the completion string 300. As described above with respect to other aspects of the disclosure, the work string 302 (including the sleeve 318 and the recess 312 in the inner surface 304) and the completion string 300 may together form a first chamber 322 on a side of the sleeve 318 and a second chamber 324 on another side of the sleeve 318. A first fluid passageway 326 in the work string 302 may be in fluid communication with the first chamber 322. A second fluid passageway 328 may be in fluid communication with the second chamber 324. A plurality of sealing elements, for example seals 330*a*, 330*b*, 330*c*, and 330*d* can prevent a fluid 140 from exiting the first chamber 322 when the fluid 140 is pumped into the first chamber 322 through the first fluid passageway 326 to position the sleeve 318 in the open position as shown in FIG. 9. Another plurality of sealing elements, for example seals 330*f*, 330*g*, and 330*h* can prevent the fluid 140 from exiting the second chamber 324 when the fluid 140 is pumped through the second fluid passageway 328 to position the sleeve 318 in the closed position (not shown). In some aspects, additional sealing elements, for example seal 330*e* may be positioned on the sleeve 318. In some aspects work string 302 may have an additional opening formed in its length, as shown in dashed lines 332, which may permit fluid to flow into an inner region 334 of the work string 302.

Example #1: A completion string can include an outer surface and an inner surface, a first fluid passageway being defined between the outer surface and the inner surface. The inner surface may define an inner region of the completion string and having a recess in the inner surface that is sized to receive a sleeve that is moveable between an open position and a closed position. The inner region may be sized to receive a work string at a position at which a surface of the work string cooperates with the sleeve and the inner surface of the completion string to define a first chamber on a side of the sleeve. The first chamber may be hydraulically sealed by a plurality of sealing elements, the work string defining a second fluid passageway to provide fluid communication with the first chamber.

Example #2: The completion string of Example #1 may further feature the inner surface of the completion string having a second recess in the inner surface that is sized to receive a second sleeve that is moveable between an open position and a closed position. The inner region may sized to receive the work string at a position at which the surface of the work string cooperates with the second sleeve and the inner surface of the completion string to define a second chamber on a side of the second sleeve, the second chamber being hydraulically sealed by additional sealing elements. The work string may define a third fluid passageway to provide fluid communication with the second chamber.

Example #3: The completion string of any of Examples #1-2 may further feature at least one sealing element of the plurality of sealing elements being an O-ring.

Example #4: The completion string of any of Examples #1-3 may further feature at least one sealing element of the plurality of sealing elements being positioned on the inner surface of the completion string proximate to the first chamber.

Example #5: The completion string of any of Examples #1-4 may further feature at least one sealing element of the plurality of sealing elements is positioned on the sleeve of the completion string.

Example #6: The completion string of any of Examples #1-5 may further feature the sleeve defining a third fluid passageway between an outer surface of the sleeve and an inner surface of the sleeve, the sleeve being configured to align the third fluid passageway of the sleeve with the first fluid passageway of the completion string in the open position.

Example #7: The completion string of any of Examples #1-6 may further feature the work string cooperating with the sleeve and the inner surface of the completion string to define a second chamber on an opposite side of the sleeve, the second chamber being hydraulically sealed by a second plurality of sealing elements, wherein the work string defines a third fluid passageway to provide fluid communication with the second chamber.

Example #8: The completion string of Example #2 may further feature first fluid passageway and the third fluid passageway being in fluid communication with one another.

Example #9: The completion string of any of Examples #1-8 may further feature the work string having an additional fluid passageway defined between an outer surface of the work string and the inner surface of the work string, the additional fluid passageway in the work string being substantially aligned with the first fluid passageway in the completion string.

Example #10: A work string may positionable within a completion string and may include an outer surface and an inner surface, the outer surface of the work string may be sized to be received within a completion string at a position at which the outer surface of the work string cooperates with a sleeve of the completion string and an inner surface of the completion string to define a first chamber on a side of the sleeve. The first chamber may be hydraulically sealed by a plurality of sealing elements. The work string may define a first fluid passageway to provide fluid communication with the first chamber.

Example #11: The work string of Example #10 may further feature the outer surface of the work string being sized to be received within the completion string at a position at which the outer surface of the work string cooperates with the sleeve and the inner surface of the completion string to define a second chamber on an opposite side of the sleeve, the second chamber being hydraulically sealed by a second plurality of sealing elements, the work string defining a second fluid passageway to provide fluid communication with the second chamber.

Example #12: The work string of Example #10 may further feature the outer surface of the work string being sized to be received within the completion string at a position at which the outer surface of the work string cooperates with a second sleeve of the completion string and the inner surface of the completion string to define a second chamber on a side of the second sleeve. The second chamber may be hydraulically sealed by a second plurality of sealing elements, the work string defining a second fluid passageway to provide fluid communication with the second chamber.

Example #13: The work string of Example #12 may further feature the first fluid passageway and the second fluid passageway of the work string being in fluid communication with one another.

Example #14: The work string of Example #12 may further feature the first fluid passageway and the second fluid passageway of the work string being fluidly isolated from one another.

Example #15: The work string of any of Examples #12-14 may further feature at least one sealing element of the plurality of sealing elements is positioned on the outer surface of the work string.

Example #16: The work string of any of Examples #10-15 may further feature the work string having a second fluid passageway defined between the outer surface of the work string and the inner surface of the work string. The third fluid passageway in the work string may be substantially aligned with a fourth fluid passageway between an outer surface and the inner surface of the completion string.

Example #17: A tubing assembly may include a completion string and a work string. The work string may be positionable within the completion string. The completion string may have an outer surface and an inner surface. A first fluid passageway may be defined between the outer surface and the inner surface. One of the completion string and the work string may have a recess that is sized to receive a sleeve that is moveable between an open position and a closed position. The inner surface of the completion string may define an inner region of the completion string sized to receive the work string at a position at which a surface of the work string cooperates with the inner surface of the completion string and the sleeve to define a first chamber on a side of the sleeve. The first chamber may be hydraulically sealed by a plurality of sealing elements. The work string may define a second fluid passageway to provide fluid communication with the first chamber.

Example #18: The tubing assembly of Example #17 may further feature the recess that being sized to receive the sleeve being in an outer surface of the work string.

Example #19: The tubing assembly of Example #18 may further feature the outer surface of the work string defining a second recess in the outer surface that is sized to receive a second sleeve that is moveable between an open position and a closed position. The inner region of the completion string may be sized to receive the work string at a position at which the outer surface of the work string cooperates with the inner surface of the completion string to define a second chamber on a side of the second sleeve that is hydraulically sealed by additional sealing elements. The work string may include a third fluid passageway to provide fluid communication with the second chamber.

Example #20: The tubing assembly of Example #19 may further feature the second fluid passageway being in fluid communication with the third fluid passageway.

The foregoing description of the aspects, including illustrated aspects, of the present disclosure has been presented only for the purpose of illustration and description and is not intended to be exhaustive or to limit the subject matter to the precise forms disclosed. Numerous modifications, adaptations, and uses thereof will be apparent to those skilled in the art without departing from the scope of this subject matter.

What is claimed is:

1. A tubing assembly comprising:

a completion string further comprising:

an outer surface;

an inner surface, the inner surface of the completion string defining an inner region of the completion string; and a completion string opening extending between the outer surface and the inner surface of the completion string; and a work string positionable within the inner region of the completion string, the work string further comprising:

an outer surface comprising a first recess; and a first sleeve positioned within the first recess, the first sleeve being moveable between an open position and a closed position, wherein the inner region of the completion string is sized to receive the work string at a position at which the outer surface of the work string and the first sleeve cooperates with the inner surface of the completion string to define a first chamber on a first side of the first sleeve, the first chamber being hydraulically sealed by a plurality of sealing elements, wherein the work string includes a first fluid passageway positioned between an inner surface of the work string and the outer surface of the work string to provide fluid communication with the first chamber.

2. The tubing assembly of claim 1, the work string further comprising:

a second recess; and a second sleeve positioned within the second recess, the second sleeve being moveable between an open position and a closed position, wherein the inner region of the completion string is sized to receive the work string at a position at which the outer surface of the work string and the second sleeve cooperates with the inner surface of the completion string to define a second chamber on a first side of the second sleeve, the second chamber being hydraulically sealed by a plurality of sealing elements, wherein the work string includes a second fluid passageway to provide fluid communication with the second chamber.

3. The tubing assembly of claim 2, wherein the first fluid passageway and the second fluid passageway are in fluid communication with one another.

4. The tubing assembly of claim 2, wherein the first fluid passageway and the second fluid passageway are fluidly isolated from one another.

5. The tubing assembly of claim 2, wherein the inner region of the completion string is sized to receive the work string at a position at which the outer surface of the work string and the first sleeve cooperate with the inner surface of the completion string to define a third chamber on a second side of the first sleeve, wherein the inner region of the completion string is sized to receive the work string at a position at which the outer surface of the work string and the second sleeve cooperate with the inner surface of the completion string to define a fourth chamber on a second side of the second sleeve, wherein the work string includes a third fluid passageway to provide fluid communication with the third chamber, and wherein the work string includes a fourth fluid passageway to provide fluid communication with the fourth chamber.

6. The tubing assembly of claim 5, wherein the third fluid passageway and the fourth fluid passageway are in fluid communication with one another.

7. The tubing assembly of claim 5, wherein the third fluid passageway and the fourth fluid passageway are fluidly isolated from one another.

8. The tubing assembly of claim 1, wherein the first sleeve has a first sleeve opening extending between an outer surface of the first sleeve and an inner surface of the first sleeve.

9. The tubing assembly of claim 8, wherein the work string has a work string opening extending between the outer surface of the work string and the inner surface of the work string, the work string opening being substantially aligned with the completion string opening.

10. A work string comprising:

an outer surface;

an inner surface;

a first recess in the outer surface of the work string;

a first sleeve positioned in the first recess, the first sleeve being movable between an open position and a closed position;

a second recess in the outer surface of the work string;

a second sleeve positioned in the second recess, the second sleeve being movable between an open position and a closed position;

wherein, the outer surface of the work string is sized to be received within a completion string at a position at which (1) the outer surface of the work string and the first sleeve cooperate with an inner surface of the completion string to define a first chamber on a first side of the first sleeve, and (2) the outer surface of the work string and the second sleeve cooperate with the inner surface of the completion string to define a second chamber on a first side of the second sleeve, wherein the first chamber is hydraulically sealed by a plurality of sealing elements, wherein the second chamber is hydraulically sealed by a plurality of sealing elements, wherein the work string defines a first fluid passageway positioned between the inner surface of the work string and the outer surface of the work string to provide fluid communication with the first chamber, and wherein the work string defines a second fluid passageway to provide fluid communication with the second chamber.

11. The work string of claim 10, wherein the first fluid passageway and the second fluid passageway are in fluid communication with one another.

12. The completion string of claim 10, wherein the first fluid passageway and the second fluid passageway are fluidly isolated from one another.

13. The work string of claim 10, wherein the work string has a work string opening extending between the outer surface of the work string and the inner surface of the work string.

14. A method for hydraulically shifting a sleeve downhole in a wellbore, the method comprising:

providing a work string comprising:

an inner surface;

an outer surface;

a first recess in the outer surface of the work string;

a first sleeve positioned in the first recess, the first sleeve being movable between an open position and a closed position;

a second recess in the outer surface of the work string;

a second sleeve positioned in the second recess, the second sleeve being movable between an open position and a closed position;

positioning the work string downhole within an inner region of a completion string at a position in which, (1) the outer surface of the work string and the first sleeve cooperate with an inner surface of the completion string to define a first chamber on a first side of the first sleeve, and (2) the outer surface of the work string and the second sleeve cooperate with the inner surface of the completion string to define a second chamber on a first side of the second sleeve;

actuating the first sleeve from the closed position to the open position by forcing fluid from a fluid source into the first chamber via a first fluid passageway in the work string positioned between the inner surface of the work string and the outer surface of the work string.

15. The method of claim 14, further comprising:

actuating the second sleeve from the closed position to the open position by forcing fluid from a fluid source into the second chamber via a second fluid passageway in the work string.

16. The method of claim 15, wherein the step of actuating the second sleeve from the closed position to the open position by forcing fluid from a fluid source into the second chamber via a second fluid passageway in the work string is performed substantially concurrently with the step of actuating the first sleeve from the closed position to the open position by forcing fluid from a fluid source into the first chamber via a first fluid passageway in the work string, wherein the first fluid passageway and the second fluid passageway are in fluid communication with one another.

17. The method of claim 16, wherein the step of actuating the second sleeve from the closed position to the open position by forcing fluid from a fluid source into the second chamber via a second fluid passageway in the work string is performed substantially concurrently with the step of actuating the first sleeve from the closed position to the open position by forcing fluid from a fluid source into the first chamber via a first fluid passageway in the work string further comprises the first fluid passageway and the second fluid passageway being in fluid communication with one another.

18. The method of claim 17, wherein the first fluid passageway and the second fluid passageway receive fluid from the same fluid source.

19. The method of claim 15, wherein the step of actuating the second sleeve from the closed position to the open position by forcing fluid from a fluid source into the second chamber via a second fluid passageway in the work string is performed independently of the step of actuating the first sleeve from the closed position to the open position by forcing fluid from a fluid source into the first chamber via a first fluid passageway in the work string, wherein the first fluid passageway and the second fluid passageway are fluidly isolated from one another.

20. The method of claim 19, wherein the first fluid passageway and the second fluid passageway receive fluid from different fluid sources.

* * * * *